United States Patent [19]

Lorg

[11] Patent Number: 4,691,478

[45] Date of Patent: Sep. 8, 1987

[54] INFILTRATION CONTROL DEVICE

[76] Inventor: John W. Lorg, 1235 A Woodchase La., Chesterfield, Mo. 63017

[21] Appl. No.: 911,513

[22] Filed: Sep. 25, 1986

[51] Int. Cl.[4] ..... E06B 7/16

[52] U.S. Cl. ..... 49/499; 49/488

[58] Field of Search ..... 49/488, 475, 492, 493, 49/485, 470, 472, 498, 499, 500

[56] References Cited

U.S. PATENT DOCUMENTS

| | | | |
|---|---|---|---|
| 712,240 | 10/1902 | Barnes et al. | 49/499 X |
| 1,452,703 | 4/1923 | Pollard | 49/499 X |
| 2,549,284 | 4/1951 | Baker | 49/470 X |
| 3,254,453 | 6/1966 | Dennis | 49/482 |

FOREIGN PATENT DOCUMENTS

| | | | |
|---|---|---|---|
| 486162 | 5/1938 | United Kingdom | 49/475 |

*Primary Examiner*—Kenneth Downey

*Attorney, Agent, or Firm*—Litman, Day & McMahon

[57] ABSTRACT

An infiltration control device comprises an elongated fabric strip with opposite side margins overlapping at a lap seam to form an elongated tube. The tube is filled with an insulative material. A fastener is provided for releasably securing the tube on the operable element of a door, window or the like.

16 Claims, 3 Drawing Figures

INFILTRATION CONTROL DEVICE

BACKGROUND OF THE INVENTION

1. Field of the Invention.

The present invention relates generally to infiltration control devices and in particular to such a device for doors and windows.

2. Description of the Prior Art.

Weather sealing and weatherstripping devices are commonly provided around various openings in enclosures of various types wherein temperatures are maintained at different levels than exterior or ambient temperatures. Enclosures such as buildings generally include doors which open and close to allow ingress and egress. Operable windows may also be provided for ventilation, emergency egress, etc. Building codes generally specify minimum numbers and sizes of doors and operable windows, which are collectively referred to as fenestration.

In most buildings the fenestration is a major source of heat loss and heat gain; and in many residential dwelling units it is probably the single largest source. One reason for the relatively large thermal transfer through the fenestration is that the door and window materials—e.g. glass, aluminum, etc.—often have very low insulative values in comparison with other parts of the structure such as the walls and the roof. A second reason relates to air infiltration around the fenestration. The present invention deals with the latter source of thermal transfer.

The difficulties in providing weather-tight seals in doors and operable windows are well known, and a variety of different devices have heretofore been proposed which address this problem. For example, a common practice is to provide an elastomeric weatherstrip around all moving parts of doors and operable windows so that when they are closed the weatherstrip compresses and seals the gaps between the moving and non-moving parts. Although such weatherstrips are usually somewhat effective, it is often particularly difficult to achieve an effective airtight seal along the thresholds of doors and the sills of operable windows. Door and window openings as well as the units themselves often distort from their original configurations whereby gaps and leaks can occur which permit more infiltration. Such distortion can be caused by settlement of the structure itself which causes displacement between the openings and the fenestration units and also by warpage of the fenestration units. In wood-frame structures, such problems are particularly common, and represent a major cause of thermal transfer from conditioned air inside the structure escaping to the outside or from outside air entering the structure.

One type of prior art device designed to reduce thermal transmission at door thresholds and window sills comprises an unattached tube of flexible material, such as fabric, filled with an insulating material and placed adjacent to the inside edge of a door threshold or window sill. However, such devices interfere with the normal ingress and egress through a door and can prevent closure of a door or window if improperly placed.

Heretofore, there has not been available an infiltration control device with the advantages and features of the present invention.

SUMMARY OF THE INVENTION

In the practice of the present invention, an infiltration control device is provided which is particularly adapted to be removably mounted on the bottom of a door or movable window sash. The device includes an elongated tube of flexible material with closed, opposite ends. The tube is filled with an insulating material, such as polystyrene beads. A hook-and-loop type fastener is provided and includes a hook strip and a loop strip adapted for releasable, intermeshing engagement. One of the hook-and-loop strips is secured to the tube along substantially the entire length thereof. The other of the hook-and-loop strips has an adhesive backing for attachment to a door, window sash and the like. A modified embodiment of the infiltration control device is also disclosed and includes a modified fastener with rib and channel strips.

OBJECTS OF THE INVENTION

The principle objects of the present invention are: to provide an infiltration control device; to provide such a device which is particularly adapted for use with doors, windows and the like; to provide such a device which is particularly adapted for use in residential units; to provide such a device which may be removably secured to doors and windows; to provide such a device which is particularly effective for diffusing air infiltration along the thresholds of doors and the sills of windows; to provide such a device which includes an insulative material; to provide such a device which is flexible enough to conform to irregular surfaces; to provide such a device which does not limit ingress or egress through a door; to provide such a device which does not interfere with the operation of a window; to provide such a device which is effective for reducing thermal transfer between the ambient atmosphere and structures which are heated and cooled; to provide such a device which reduces heating and cooling costs; to provide such a device which absorbs air infiltration and warms or cools it to a temperature approximately equal to the ambient room temperature within a structure; and to provide such a device which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
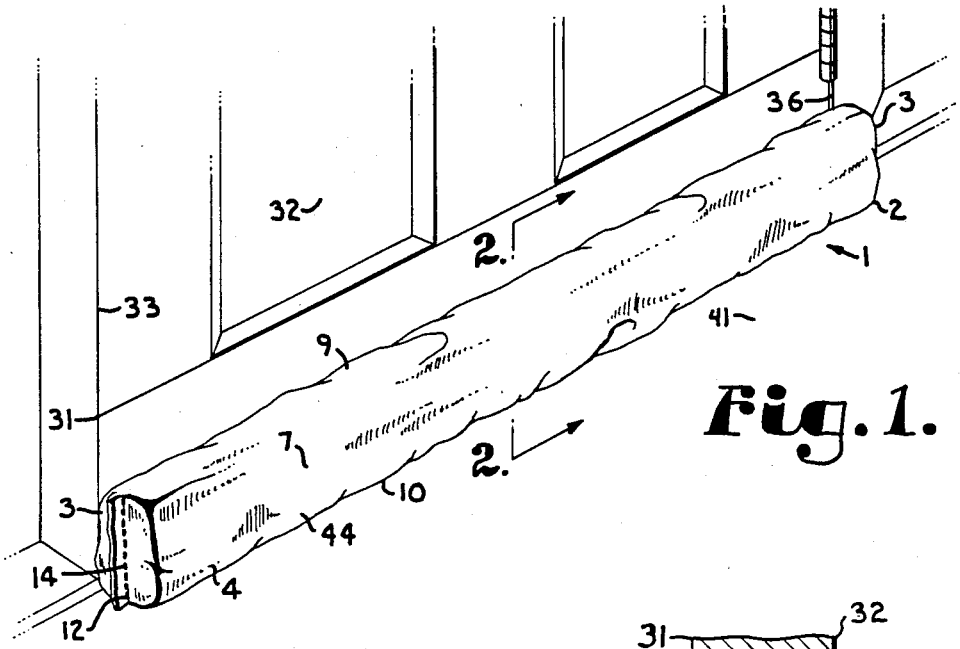
FIG. 1 is a perspective view of an infiltration control device embodying the present invention and mounted on an exterior door.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an infiltration control device embodying the present invention. The device 1 includes an elongated tube 2 with opposite ends 3, outer and inner sides 7, 8 and upper and lower edges 9, 10. The tube 2 is formed from an elongated strip 4 of a suitable material which is preferably porous, such as fabric. The material strip 4 has parallel, longitudinally-extending side margins 5 which overlap to form a lap seam 6 on the tube inner side 8. The strip 4 is secured to itself at the lap seam 6 by a pair of longitudinally-extending stitch lines 11 each positioned in proximity and parallel to a respective side edge 5. The tube 2 is thus fully enclosed and forms an interior pocket 13. The tube ends 3 are closed at respective end seams 12 with end seam stitch lines 14.

The pocket 13 is filled with a porous insulative material chosen for its porosity and its relatively high Rvalue. For example, expanded, cellular polystyrene beads 22 have been found to be well suited for this purpose. However, without limitation on the generality of useful insulative materials, others such as polyester fiber available under the trade name "Holofil", glass fiber, foam rubber, etc. may be used to fill the pocket 13 to achieve the desired result. Preferably the tube 2 when filled with insulation remains deformable, for purposes which will be explained more fully hereinafter.

A hook-and-loop type fastener 25 is provided for mounting the device 1 and includes respective hook and loop strips 26, 27. The hook strip 26 is attached to the tube back side 8 by the stitch lines 11 over the lap seam 6. Thus, three thicknesses of material are overlayed at the lap seam 6 and the hook strip 26, i.e. a double thickness of the material strip 4 plus the hook strip 26. These overlayed layers of material cooperate to somewhat stiffen and reinforce the tube 2 in this area to facilitate securing the hook-and-loop fastener 25 and to provide a better seal thereat. Furthermore, by attaching the hook strip 26 with the same stitch lines 11 as are used to secure the lap seam 6, construction of the tube 1 is simplified.

The loop strip 27 includes an adhesive backing 28 comprising, for example, double-sided tape. It will be appreciated that positions of the hook and loop strips 26, 27 may be reversed from those shown.

As shown in FIG. 1, the weather seal device 1 is adapted to be mounted on a door 31 comprising an operable element moveable between open and closed positions, preferably on an interior face 32 of an exterior door. The door 31 is flanked on either side by a casing 33. A threshold 34 comprising a fixed element extends horizontally between the casing 33 and immediately below a bottom edge 35 of the door 31. The door casing 33 and the threshold 34 form a door opening 36 which receives the door 31 in its closed position.

The loop strip 37 is mounted on the interior face 32 of the door 31 in spaced relation above and parallel to its bottom edge 35 by exposing the adhesive backing 28 thereon and pressing it against the door interior face 32. With the loop strip 27 thus mounted, the hook strip 26 may be pressed thereagainst to attach the device 1 to the door 3.

The infiltration control device 1 is substantially the same width as the door opening 36 so that the ends 3 of the former are adjacent to the casing 33 when the door 31 is closed.

In operation, the infiltration control device 1 is positioned so that its lower edge 10 is located slightly below the door bottom edge 35 and rests on a floor surface 41.

Preferably the position of the device 1 is such that its overall height is somewhat reduced by the lower edge 10 engaging the floor surface 41 whereby a lateral bulge 44 is created on the inner side 8 adjacent to the lower edge 10. With the bulge 44, the tube 2 assumes a slightly greater transverse thickness at an area in horizontal alignment with a gap 45 formed between the threshold 34 and the door bottom edge 35. The tube 2 is positioned by lowering it along the door interior face 32 until the tube lower edge 10 engages the floor surface 41, then lowering it a slight additional amount to create the bulge 44 and to ensure a relatively wide contact area 46 between the tube lower edge 10 and the floor surface 41.

In operation, the infiltration control device 1 functions primarily to diffuse air drafts entering the structure through the gap 45 and to prevent the outflow of conditioned air from within the structure. In many structures, gaps such as that shown at 45 are present between the bottom edges and thresholds of exterior doors. Such gaps are difficult to completely close because the doors are generally subjected to frequent openings and closings and persons entering and leaving the structure tread upon the threshold. Furthermore, the temperature differential present at an exterior door may cause certain materials to distort.

Figure 2:
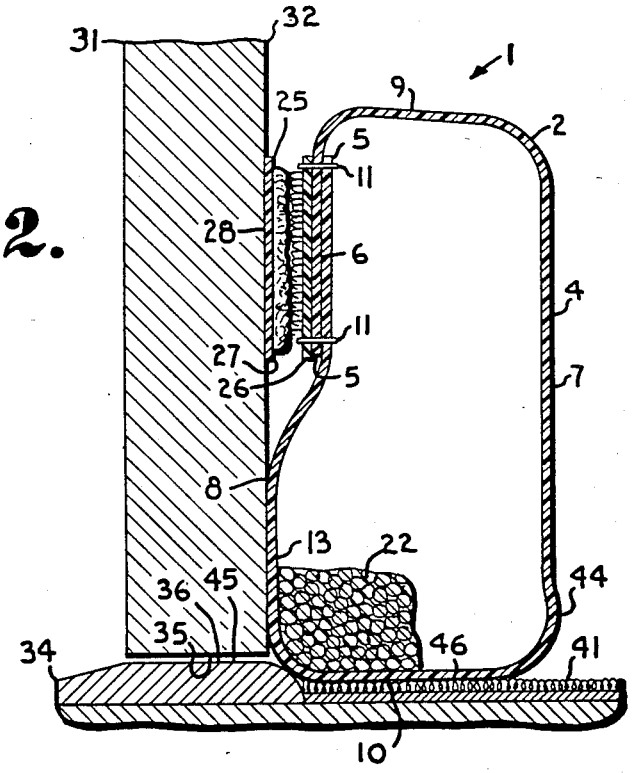
FIG. 2 is a vertical cross-section of an infiltration control device taken generally along line 2—2 in FIG. 1.

With the infiltration control device 1 of the present invention properly positioned as shown in FIG. 2, air entering the structure through the gap 45 is entrapped within the tube 2 so that it is warmed (or cooled) to the temperature of the ambient air within the structure and gradually released from the tube 2. The porous material 4 passes the entering air draft into the pocket 3 wherein it is dissipated amongst the air spaces between the polystyrene beads 22. The cold air molecules are thus warmed to substantially the existing room temperature before being released from the tube 2. Thus, for the proper function of the infiltration control device 1, it is preferable that porous materials be used so that the entering cold air is actually warmed and diffused rather than blocked. However, a certain amount of blockage will in fact occur due to the thickness of the tube 2. In particular, the tube 2 is relatively thick adjacent to its lower edge 10 because of the presence of the bulge 44. The bulge 44 is thus formed by gravity at the location where it is most beneficial to the operation of the device 1, i.e. in line horizontally with the gap 45.

Thus, with the door 31 closed within the opening 36, the device 1 effectively prevents a thermal transfer between the interior of the structure and the outside ambient atmosphere which might otherwise occur through the gap 45 between the threshold 34 and the door bottom edge 35. In cool weather, the infiltration control device 1 prevents the entry of cold air drafts into the structure and blocks the warmer air therein from escaping. In hot weather when air conditioning is required to cool the interior of the structure, the seal device 1 likewise prevents cool inside air from escaping and blocks the entry of warmer outside air.

Because the seal device 1 comprises predominantly lightweight material such as polystyrene beads 22, it easily slides across the floor surface 41 when the door 31 is open. This is particularly advantageous since the device 1 will cause virtually no wear on the floor surface 41. Furthermore, due to its relatively light weight the device 1 is not likely to become jammed between the door bottom edge 35 and the floor surface 41. Rather, it tends to glide relatively easily across the latter. However, when the door 31 is closed the deformable nature of the device 1 causes it to assume the configuration of the door 31 adjacent to its bottom edge 35, the threshold 34 and the floor surface 41 with which it is in contact.

It will be appreciated that the hook-and-loop type fastener 25 in cooperation with the deformable nature of the tube 2 allows for independent vertical adjustment of the tube 2 throughout its length. Thus, high spots and low spots in the threshold 34 and the floor surface 41 can be accommodated if necessary.

The infiltration control device 1 is easily removable from the door 31 by merely pulling the hook-and-loop fastener 25 apart. The fabric, polystyrene beads 22 and the hook strip 26 are all washable so that the device 1 may be cleaned as often as necessary.

Figure 3:
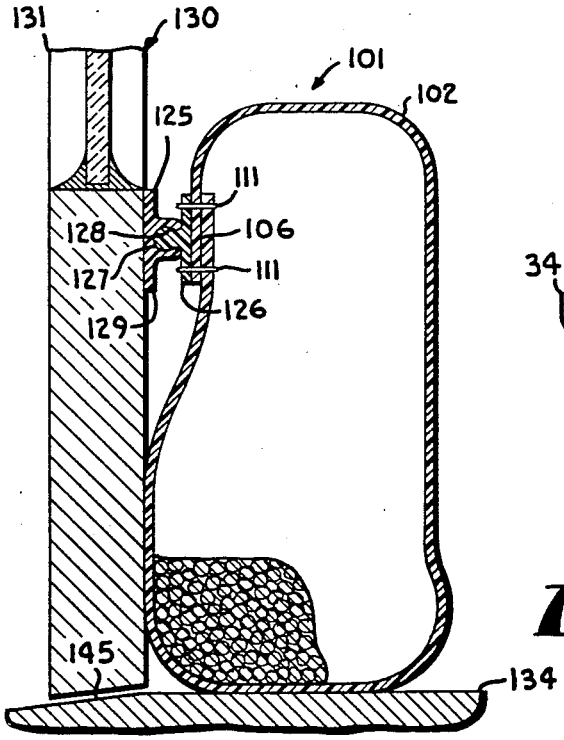
FIG. 3 is a vertical cross-section of an infiltration control device comprising a first modified embodiment of the present invention with a modified fastener and mounted on a window sash.

An infiltration control device 101 comprising a first modified embodiment of the present invention is shown in FIG. 3. The infiltration control device 101 includes a tube 102 forming a lap seam 106 secured by a pair of longitudinally-extending, parallel stitch lines 111. A modified fastener 125 is provided for securing the tube 2 to an operable element comprising a sash 131 of a window assembly 130, for example, a single-hung or double-hung window unit. The window assembly 130 also includes a sill 134 comprising a fixed element on which the sash 131 rests in its closed position. The fastener 125 includes a rib strip 126 with a longitudinally-extending rib 127 having a partially circular cross-sectional configuration. The rib 127 is releasably received in and partially surrounded by a channel strip 128 of the fastener 125. The rib strip 126 is secured to the tube 102 over the lap seam 106 thereof by the stitch lines 111. The channel strip 129 of the fastener 125 is mounted on the sash 131 by a suitable, for example, adhesive, fastening means. The channel strip 128 preferably comprises a deformable material which expands to receive the rib 127 and then contracts to securely enclose it with the tube 102 mounted on the window sash 131.

In operation, the modified infiltration control device 101 performs in substantially the same manner as the previously described device 1 to control air flow between the interior of the structure and the exterior through a gap 145 between the sash 131 and the sill 134.

Furthermore, it is anticipated that the infiltration control device of the present invention can be mounted on a door or window by various alternative types of fasteners. For example, snaps, zippers and the like could be provided for removably mounting the device. Alternatively, it could be more permanently mounted by, for example, staples, tacks, adhesive, etc.

It is to be understood that while certain forms of the present invention have been illustrated and described herein, it is not to be limited to the specific forms or arrangement of parts described and shown.

What is claimed and desired to be secured by Letters Patent is as follows:

1. An infiltration control device for doors, operable windows and the like which comprises:
(a) an elongated tube, which includes:
(1) inner and outer sides;
(2) upper and lower edges;
(3) a fabric strip with opposite, overlapping side margins at said inner side;
(4) said strip being secured to itself at a lap seam adjacent to said side margins;
(5) opposite closed ends; and
(6) an enclosed pocket;
(b) insulation materials substantially filling said pocket; and
(c) longitudinally-extending fastener means secured to said tube over said seam thereof and adapted for mounting said device on a door, operable window or the like.

2. The device according to claim 1 wherein:
(a) said insulation material comprises polystyrene beads.

3. The device according to claim 1 wherein:
(a) said fastener means comprises a hook-and-loop type fastener including a hook strip and a loop strip, one of said hook and look strips being affixed to said tube.

4. The device according to claim 3 wherein said other of said hook and loop strips includes an adhesive mounting strip adapted for attachment to said door, operable window or the like.

5. The device according to claim 4 wherein said adhesive mounting strip comprises two-sided tape.

6. The device according to claim 3 wherein:
(a) said one strip and said lap seam are secured together by a pair of longitudinally-extending, parallel stitched seams extending through said fabric and said one strip.

7. The device according to claim 1 wherein:
(a) said insulation material comprises polyester fiber.

8. In a fenestration unit assembly having a fixed surface and an operable element moveable between open and closed positions, said operable element being in closely-spaced relation to said fixed element in its closed position, the improvement of an infiltration control device, which comprises:
(a) an elongated tube including:
(1) inner and outer sides;
(2) a fabric strip with opposite side margins, said strip being connected to itself at a lap seam adjacent to said strip side margins;
(3) a pair of longitudinally-extending stitched seams at said lap seam;
(4) a pair of opposite, closed ends;
(5) an enclosed pocket formed by said tube; and
(6) upper and lower edges;
(b) a fastener adapted for releasably fastening said tube on said operable element, said fastener including a first elongated fastener strip attached to said tube by said stitched seams over said lap seam and a second fastener strip attached to said fixed element;
(c) insulating materials substantially filling said pocket; and
(d) said tube being mounted on said operable element whereby said tube lower edge engages said fixed surface with said operable element in its closed position, said tube being vertically adjustable along substantially its entire length.

9. The device according to claim 8 wherein:

(a) said fastener comprises a hook-and-loop type fastener with one of said fastener strips comprising a plurality of hook means and the other of said fastener strips comprising a plurality of loop means.

10. The device according to claim 8 wherein:

(a) with said operable element in its closed position, said tube deforms and creates a bulge extending from said tube outer side adjacent to said tube lower edge whereat said tube has a maximum crossectional thickness.

11. The device according to claim 8 wherein said insulating material comprises polystyrene beads.

12. The device according to claim 8 wherein said insulating material comprises polyester fiber.

13. The device according to claim 8 wherein:

(a) said fenestration unit includes a casing, said tube ends being adapted to engage said casing with said operable element in its closed position.

14. The device according to claim 8 wherein:

(a) one of said fastener strips includes an elongated, longitudinally-extending rib; and (b) the other of said fastening strips includes an elongated, longitudinally-extending channel adapted to releasably receive said rib.

15. The device according to claim 8 wherein said fenestration unit comprises a door.

16. The device according to claim 8 wherein said fenestration unit comprises a window.

* * * * *